US009352924B2

(12) United States Patent
Hori et al.

(10) Patent No.: US 9,352,924 B2
(45) Date of Patent: May 31, 2016

(54) PRINTER

(71) Applicant: FUNAI ELECTRIC CO., LTD., Osaka (JP)

(72) Inventors: Yutaka Hori, Higashiosaka (JP); Daisuke Ogawa, Daito (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 14/609,788

(22) Filed: Jan. 30, 2015

(65) Prior Publication Data

US 2015/0217962 A1 Aug. 6, 2015

(30) Foreign Application Priority Data

Jan. 31, 2014 (JP) ..... 2014-017067

(51) Int. Cl.

| | |
|---|---|
| ***B65H 31/00*** | (2006.01) |
| ***B41J 2/01*** | (2006.01) |
| ***B41J 29/02*** | (2006.01) |
| ***B41J 29/13*** | (2006.01) |
| ***B65H 31/02*** | (2006.01) |

(52) U.S. Cl.

CPC . *B65H 31/00* (2013.01); *B41J 2/01* (2013.01); *B41J 29/02* (2013.01); *B41J 29/13* (2013.01); *B65H 31/02* (2013.01); *B65H 2301/4212* (2013.01); *B65H 2402/46* (2013.01); *B65H 2403/945* (2013.01); *B65H 2405/1117* (2013.01); *B65H 2405/324* (2013.01); *B65H 2801/12* (2013.01)

(58) Field of Classification Search

CPC ..... B65H 31/00; B65H 2405/11; B65H 2405/115; B65H 2405/121; B65H 2405/324; B65H 2405/35; B65H 2405/354; B41J 11/56; B41J 11/58; B41J 11/62; B41J 13/00; B41J 13/10; B41J 13/106; B41J 25/00; B41J 29/13; B41J 29/54; B41J 29/58; B41J 29/70

USPC ..... 271/162, 207, 213; 347/104

See application file for complete search history.

(56) References Cited

U.S. PATENT DOCUMENTS

| | | | | |
|---|---|---|---|---|
| 6,969,169 | B2 | 11/2005 | Tanaami et al. | |
| 7,350,914 | B2 | 4/2008 | Tanaami et al. | |
| 7,398,968 | B2 * | 7/2008 | Learmonth | G03G 21/1609 271/145 |
| 7,976,020 | B2 | 7/2011 | Awai | |
| 2003/0052956 | A1 * | 3/2003 | Katsuyama | B41J 13/103 347/108 |
| 2004/0067089 | A1 | 4/2004 | Tanaami et al. | |
| 2005/0248647 | A1 | 11/2005 | Tanaami et al. | |
| 2007/0001382 | A1 * | 1/2007 | Matsumoto | B65H 1/02 271/162 |

(Continued)

FOREIGN PATENT DOCUMENTS

| | | |
|---|---|---|
| JP | 2004-122719 | 4/2004 |
| JP | 2006-312286 | 11/2006 |

(Continued)

*Primary Examiner* — David H Bollinger

(74) *Attorney, Agent, or Firm* — Wenderoth, Lind & Ponack, L.L.P.

(57) ABSTRACT

A printer is provided which includes an output part, a carriage, a cover, and a movable part. The output part outputs a medium, the cover openably and closably covers the output part, the carriage reciprocates in a predetermined direction, and the movable part has a contact point with which the carriage comes into contact and includes a holding part that holds the cover in a closed state such that the movable part opens the cover by pivoting when the carriage comes into contact with the contact point.

10 Claims, 7 Drawing Sheets

(56) References Cited

U.S. PATENT DOCUMENTS

| | | | | |
|---|---|---|---|---|
| 2008/0025001 | A1* | 1/2008 | Igarashi | B41J 29/13 361/726 |
| 2009/0295082 | A1* | 12/2009 | Awai | B41J 29/02 271/306 |

FOREIGN PATENT DOCUMENTS

| | | |
|---|---|---|
| JP | 4387651 | 12/2009 |
| JP | 2013-224223 | 10/2013 |

* cited by examiner

PRINTER

CROSS REFERENCE TO RELATED APPLICATION

The present application is based on and claims priority of Japanese Patent Application No. 2014-017067 filed on Jan. 31, 2014. The entire disclosure of the above-identified application, including the specification, drawings and claims is incorporated herein by reference in its entirety.

FIELD

The present invention relates to a printer that prints on a medium.

BACKGROUND

As a printer that prints on a medium, an inkjet printer is known, for example (see Patent Literature (PTL 1), for example). A housing of the inkjet printer has a feed opening for feeding a medium to be printed on into the housing, and an output opening for outputting the printed medium to the outside of the housing.

The output opening is openably and closably provided with a cover. In an open state, the cover serves as an output tray for supporting, from below, the medium outputted from the output opening.

Right before executing printing, a user opens the cover manually and inserts a medium into the feed opening. When the printing is executed, the medium is fed into the housing through the feed opening, printed on inside the housing, and then outputted to the outside of the housing through the output opening.

CITATION LIST

Patent Literature

[Patent Literature 1] Japanese Unexamined Patent Application Publication No. 2006-312286

Technical Problem

With the conventional printer described above, there is a possibility that a user forgets to open the cover right before executing printing. When the printing is executed with the cover closed, the printed medium that is not outputted from the housing gets jammed in the housing, that is, a paper jam occurs.

The present invention has been conceived to solve the problem described above, and an object of the present invention is to provide a printer capable of reducing the occurrence of a paper jam.

SUMMARY

Solution to Problem

In order to achieve the above object, a printer according to one aspect of the present invention includes: an output part for outputting a medium; a carriage that reciprocates in a predetermined direction; a cover that is openably and closably disposed so as to cover the output part; and a movable part that brings the cover to an open state when the carriage comes in contact with a point of contact of the movable part and does work on the cover at a working point.

According to this aspect, the movable part brings the cover to an open state when the carriage comes in contact with a point of contact of the movable part and does work on the cover at a working point. When the cover is brought to the open state, the output part is exposed. For example, since the carriage moves from a standby position or the like right before printing is executed, it is possible to bring the cover automatically to the open state from the closed state by the movable part releasing the cover from being held in the closed state using the force of the movement of the carriage. As a result, the printed medium can be outputted to the outside of the housing through the output part, and the occurrence of a paper jam can be reduced For instance, in the printer according to one aspect of the present invention, the movable part includes: a first pivoting part that pivots as a result of the contact; and a second pivoting part that pivots in conjunction with the pivoting of the first pivoting part, and releases the cover from a closed state and brings the cover to the open state as a result of the work.

According to this aspect, the second pivoting part pivots in conjunction with the pivoting of the first pivoting part, and brings the cover to the open state from the closed state as a result of the work. When the cover is brought to the open state, the output part is exposed. For example, since the carriage moves from a standby position or the like right before printing is executed, it is possible to bring the cover automatically to the open state from the closed state by the second pivoting part releasing the cover from being held in the closed state using the force of the movement of the carriage. As a result, the printed medium can be outputted to the outside of the housing through the output part, and the occurrence of a paper jam can be reduced.

For instance, in the printer according to one aspect of the present invention, the carriage may reciprocate in the predetermined direction within a predetermined moving range to print on the medium, and move beyond the predetermined moving range to come in contact with the first pivoting part before the medium is outputted from the output part.

According to this aspect, the carriage moves beyond the predetermined moving range to come in contact with the first pivoting part before the medium is outputted from the output part. With this, for example, right before printing is executed, it is possible to bring the cover automatically to the open state from the closed state. Moreover, when printing on the medium is executed, the carriage reciprocates in the predetermined direction within the predetermined moving range. With this, for instance, when the printing is being executed, it is possible to prevent the carriage from coming in contact with the first pivoting part.

For instance, in the printer according to one aspect of the present invention, the second pivoting part may include a hook that is engageable with the cover.

According to this aspect, since the second pivoting part includes the hook, it is possible to hold the cover in the closed state by engaging the hook with the cover.

For example, in the printer according to one aspect of the present invention, the hook may be disengaged from the cover to bring the cover to the open state from the closed state.

According to this aspect, the hook is disengaged from the cover to bring the cover to the open state from the closed state. With this, it is possible to easily release the cover from being held in the closed state by the second pivoting part.

For instance, in the printer according to one aspect of the present invention, the first pivoting part may be capable of pivoting between a first pivot position and a second pivot position, and pivot in a first direction from the first pivot position to the second pivot position when the carriage comes in contact with the first pivoting part, and the second pivoting part may be capable of pivoting between a third pivot position where the second pivoting part is engaged with the cover in the closed state and a fourth pivot position where the second cover is disengaged from the cover in the closed state, and pivot in a second direction from the third pivot position to the fourth pivot position in conjunction with the first pivoting part pivoting from the first pivot position to the second pivot position, the second direction being opposite the first direction.

According to this aspect, it is possible to cause the second pivoting part to be easily in conjunction with the first pivoting part pivoting.

For example, the printer according to one aspect of the present invention may further include a biasing member that biases the first pivoting part to the first pivot position.

According to this aspect, since the biasing member biases the first pivoting part to the first pivot position, the first pivoting part and the second pivoting part return to the first pivot position and the third pivot position, respectively, after the cover is released from being held in the closed state. With this, for instance, when a user manually closes the cover after execution of printing is completed, the second pivoting part is engaged with the cover to hold the cover in the closed state again.

For example, in the printer according to one aspect of the present invention, the first pivoting part and the second pivoting part may have an overlap region in which the first pivoting part and the second pivoting part partly overlap with each other, and in the overlap region, one of the first pivoting part and the second pivoting part may have a projecting portion, and the other of the first pivoting part and the second pivoting part may have an opening that is substantially rectangular-shaped and into which the projecting portion is movably inserted.

According to this aspect, in the overlap region, the projecting portion provided to one of the first pivoting part and the second pivoting part is movably inserted into the opening provided to the other one of the first pivoting part and the second pivoting part. With this, it is possible to cause the second pivoting part to be easily in conjunction with the first pivoting part pivoting.

For instance, in the printer according to one aspect of the present invention, a portion of the first pivoting part that comes in contact with the carriage may be disposed inside of a pivot center of the first pivoting part in the predetermined direction.

According to this aspect, the portion of the first pivoting part that comes in contact with the carriage is disposed inside of the pivot center of the first pivoting part in the predetermined direction. With this, the carriage can be brought in contact with the first pivoting part without having to move in the predetermined direction beyond the pivot center of the first pivoting part. As a result, it is possible to reduce a moving range of the carriage in the predetermined direction, and miniaturize the housing in the predetermined direction.

For example, in the printer according to one aspect of the present invention, when the hook is disengaged from the cover, the cover may be brought to the open state from the closed state due to weight of the cover.

According to this aspect, when the hook is disengaged from the cover, the cover is brought to the open state from the closed state due to the weight of the cover; thus, it is possible to simplify a structure for automatically bringing the cover to the open state from the closed state.

Advantageous Effects

In the printer according to an aspect of the present invention, the occurrence of a paper jam can be reduced.

BRIEF DESCRIPTION OF DRAWINGS

These and other objects, advantages and features of the invention will become apparent from the following description thereof taken in conjunction with the accompanying drawings that illustrate a specific embodiment of the present invention.

DESCRIPTION OF EMBODIMENT

Hereinafter, an exemplary embodiment of the present invention is described in greater detail with reference to the accompanying Drawings. Note that the exemplary embodiments described below show specific examples of the present invention. The numerical values, shapes, materials, structural elements, the arrangement and connection of the structural elements, steps, and the processing order of steps, etc. shown in the following exemplary embodiment are mere examples, and therefore do not limit the present invention, the scope of which is defined in the appended Claims. Therefore, among the structural elements in the following exemplary embodiment, structural elements not recited in any one of the independent claims are described as preferred structural elements, and are not absolutely necessary to overcome the problem according to the present invention.

Embodiment

External Structure of Printer

Figure 1:
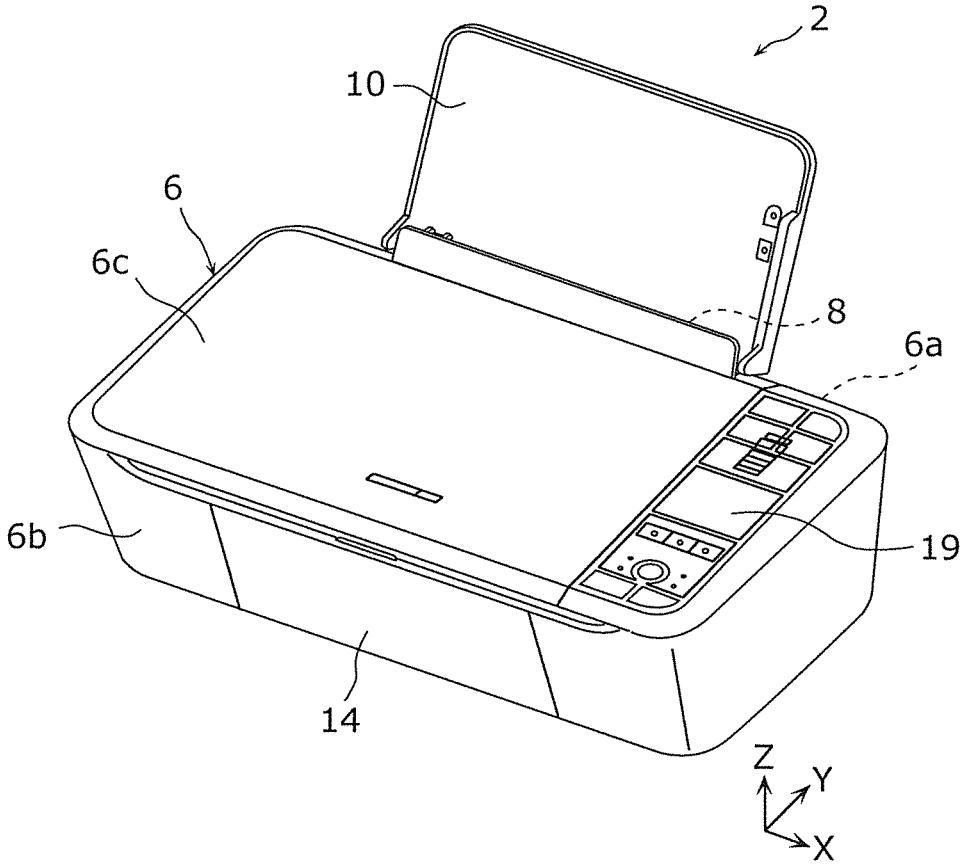
FIG. 1 is a perspective view illustrating the external appearance of a printer according to an embodiment.
Figure 2:
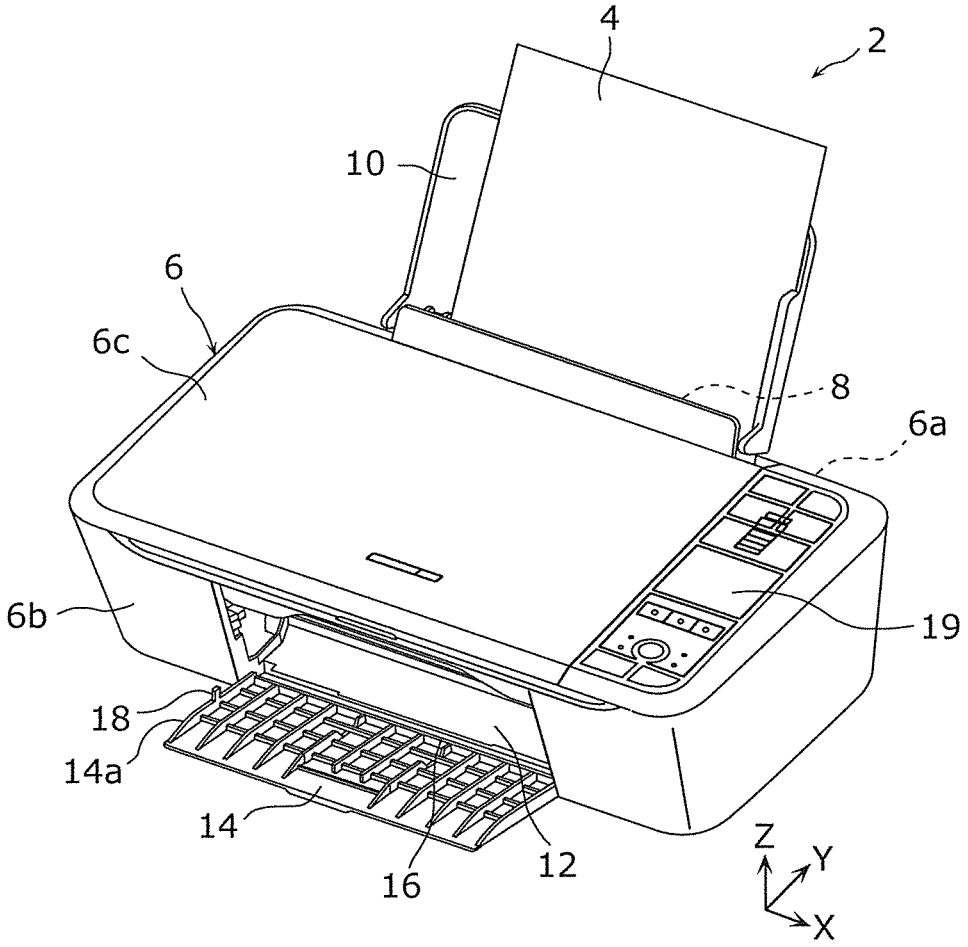
FIG. 2 is a perspective view illustrating the external appearance of a printer according to an embodiment.

First, the external structure of a printer 2 according to Embodiment will be described with reference to FIG. 1 and FIG. 2. FIG. 1 and FIG. 2 each are a perspective view illustrating the external appearance of a printer according to Embodiment.

As illustrated in FIG. 1 and FIG. 2, the printer 2 is, for example, an inkjet printer which prints by discharging ink onto a medium 4. The medium 4 is plain paper, photo paper, or a CD-ROM (Compact Disc Read Only Memory) having a printable label, for instance.

The printer 2 includes a housing 6. The housing 6 has, at an upper end of a rear surface 6*a* thereof, a feed opening 8 for feeding the medium 4 to be printed on into the housing 6. The medium 4 is inserted into the feed opening 8 from above. A feed tray 10 for supporting, from behind, the medium 4 inserted to the feed opening 8 is further fixed to the upper end of the rear surface 6*a* of the housing 6. The feed tray 10 extends obliquely upward from the feed opening 8.

The housing 6 has, in a front surface 6*b*, an output opening 12 (output part) that is substantially rectangular-shaped and for outputting to the outside of the housing 6 the medium 4 that has been printed on. The output opening 12 is openably and closably provided with a cover 14 that is substantially rectangular-shaped. The cover 14 is capable of pivoting between a pivot position (refer to FIG. 2) in an open state where the output opening 12 is exposed and a pivot position (refer to FIG. 1) in a closed state where the output opening 12 is closed, on a pivot shaft 16 provided to a lower end of the output opening 12 and extending in a substantially horizontal direction (X-axis direction). As illustrated in FIG. 1, in the closed state, the cover 14 extends slightly aslope with respect to the vertical direction (Z-axis direction). It is to be noted that the center of gravity of the cover 14 in the closed state is located further outside of the housing 6 than the pivot shaft 16 is. As illustrated in FIG. 2, in the open state, the cover 14 extends from the lower end of the output opening 12 in a substantially horizontal direction (Y-axis direction), and serves as an output tray for supporting, from below, the medium 4 outputted from the output opening 12. As illustrated in FIG. 2, a tab 18 (to be described later) is provided to an end 14*a* on the back surface of the cover 14 in the X-axis direction.

The housing 6 includes, in a top surface 6*c*, a control panel 19 for operating the printer 2 (for example, powering ON and OFF or starting printing).

Internal Structure of Printer

Figure 3:
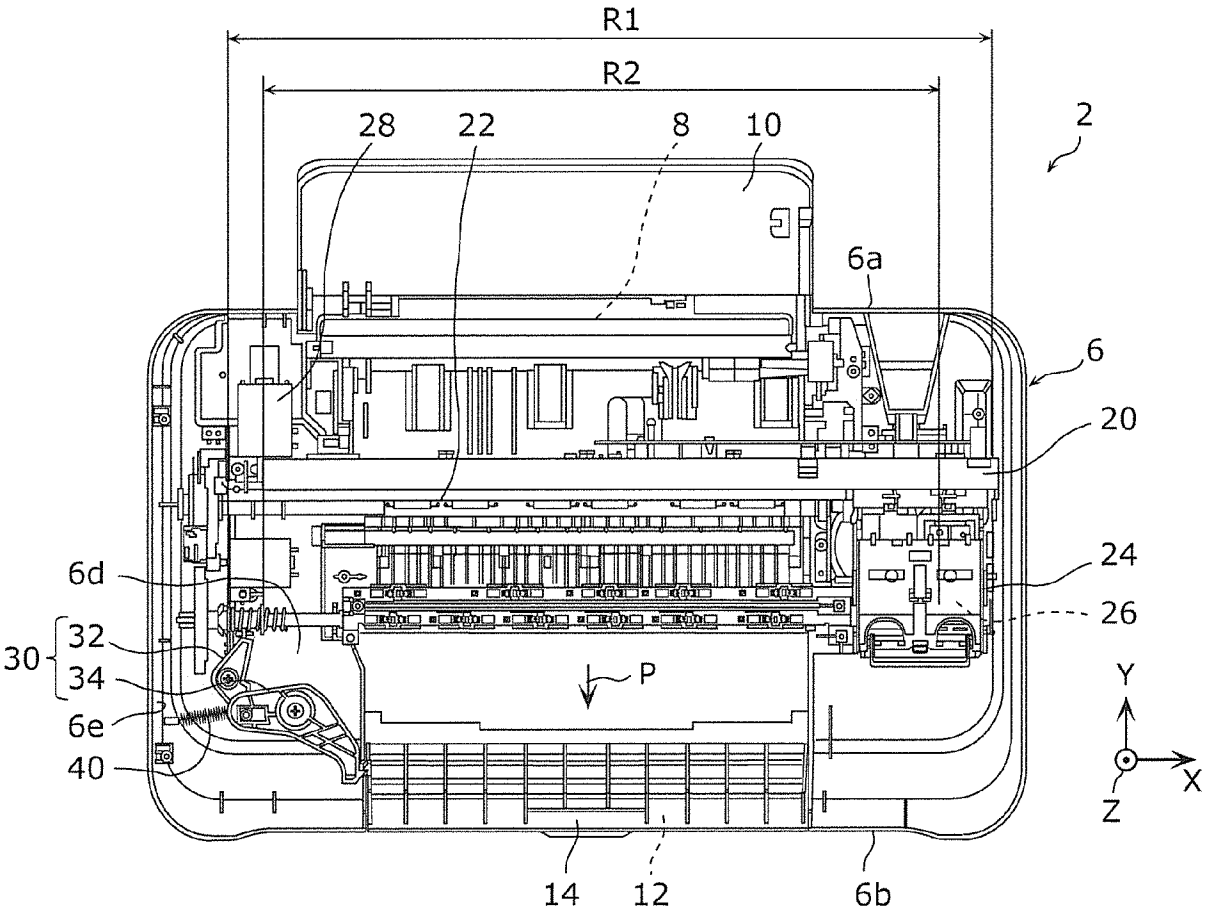
FIG. 3 is a diagram illustrating the internal structure of a printer when a cover is in a closed state.

Next, the internal structure of the printer 2 described above will be described with reference to FIG. 3. FIG. 3 is a diagram illustrating the internal structure of a printer when a cover is in a closed state.

As illustrated in FIG. 3, the housing 6 contains a frame 20. The frame 20 supports a guide shaft 22. The guide shaft 22 extends in a direction (X-axis direction) substantially orthogonal to a direction in which the medium 4 is transported (direction indicated by arrow P in FIG. 3). The guide shaft 22 supports a carriage 24 that is movable.

The carriage 24 is loaded with ink cartridges 26 that are replaceable. The ink cartridges 26 are each filled with a corresponding one of color inks such as black, cyan, magenta, and yellow. The carriage 24 further includes a recording head (not shown). The recording head includes nozzles (not shown) for discharging ink supplied from the ink cartridges 26.

The frame 20 described above further supports a motor 28 such as a servomotor. The driving force of the motor 28 is transmitted to the carriage 24 through a timing belt (not shown). With the driving force of the motor 28, the carriage 24 reciprocates along the guide shaft 22 in the X-axis direction (corresponding to predetermined direction).

It is to be noted that as illustrated in FIG. 3, right before printing is executed (i.e., before printing on the medium 4 is executed), the carriage 24 moves in the X-axis direction from a standby position (position shown in FIG. 3) within a first moving range R1. Here, when moving to a position opposite the standby position, the carriage 24 transmits force to a first pivoting part 32 (to be described later) by coming in contact with a first end 32*a* of the first pivoting part 32. Moreover, as illustrated in FIG. 3, when the printing is executed (i.e., while the printing on the medium 4 is being executed), the carriage 24 reciprocates in the X-axis direction within a second moving range R2 (corresponding to predetermined moving range) smaller than the first moving range R1. Here, when moving to a position opposite the standby position, the carriage 24 does not come in contact with the first end 32*a* of the first pivoting part 32.

The housing 6 further contains a transport mechanism (not shown). The transport mechanism is for transporting the medium 4 fed into the housing 6 through the feed opening 8, toward the output opening 12 in a direction indicated by the arrow P in FIG. 3.

In a state where the medium 4 is being transported by the transport mechanism, while the carriage 24 reciprocates in a direction substantially orthogonal to a direction in which the medium 4 is transported, ink is discharged from the nozzles of the recording head onto the medium 4, resulting in an image being printed on the medium 4.

Configuration of and Operation by Holding Mechanism

Figure 4:
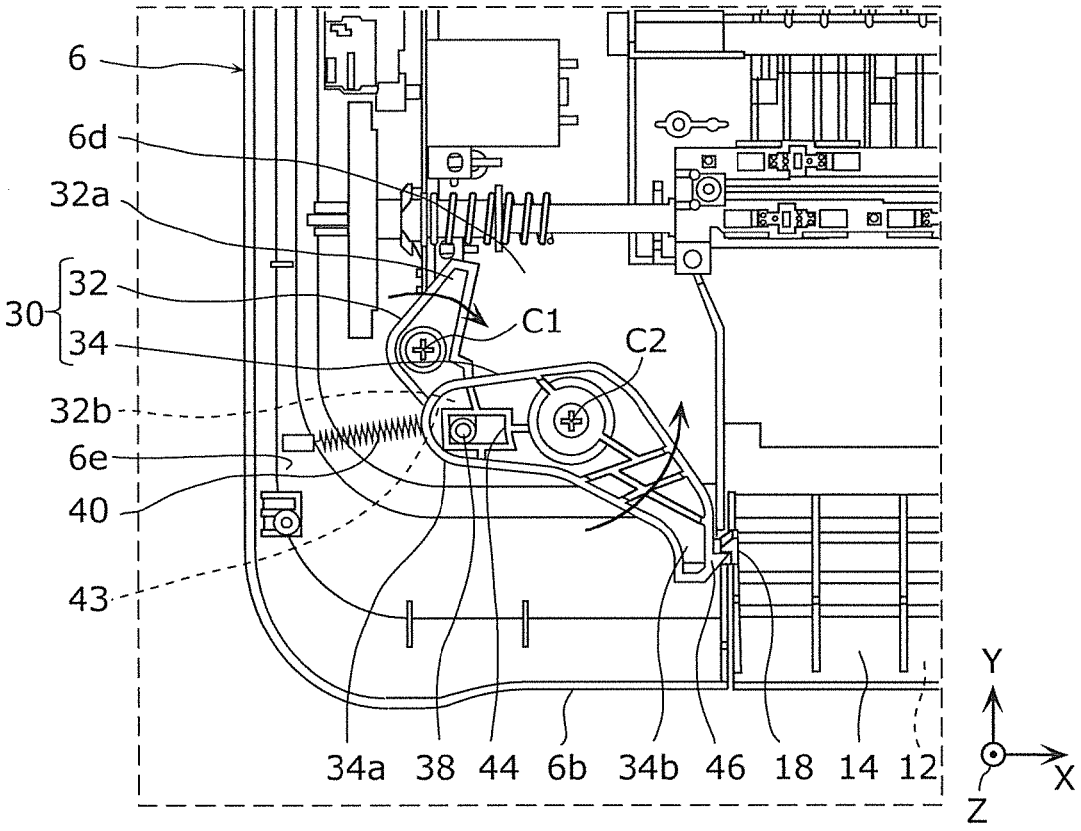
FIG. 4 is a diagram illustrating an enlarged holding mechanism that has held a cover in a closed state.
Figure 5:
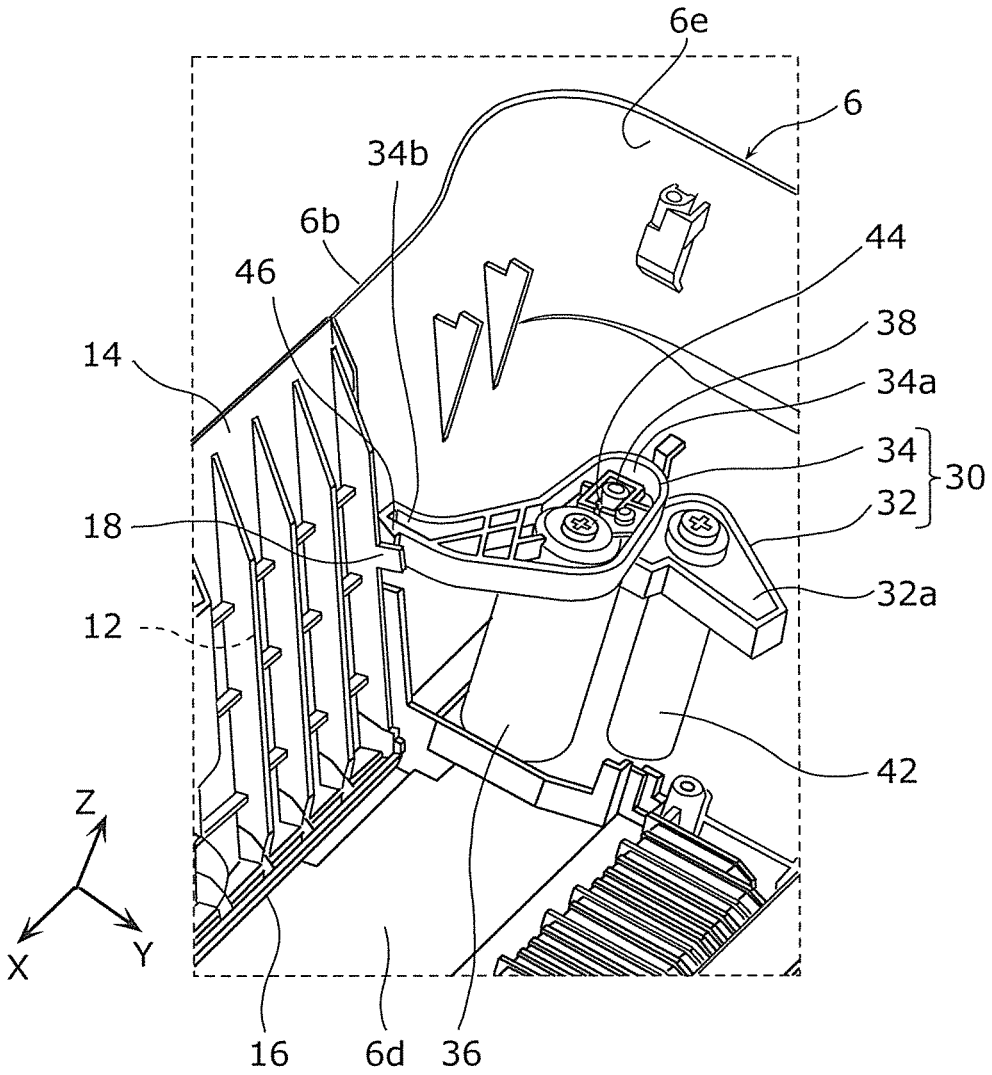
FIG. 5 is a perspective view illustrating an enlarged holding mechanism that has held a cover in a closed state.
Figure 6:
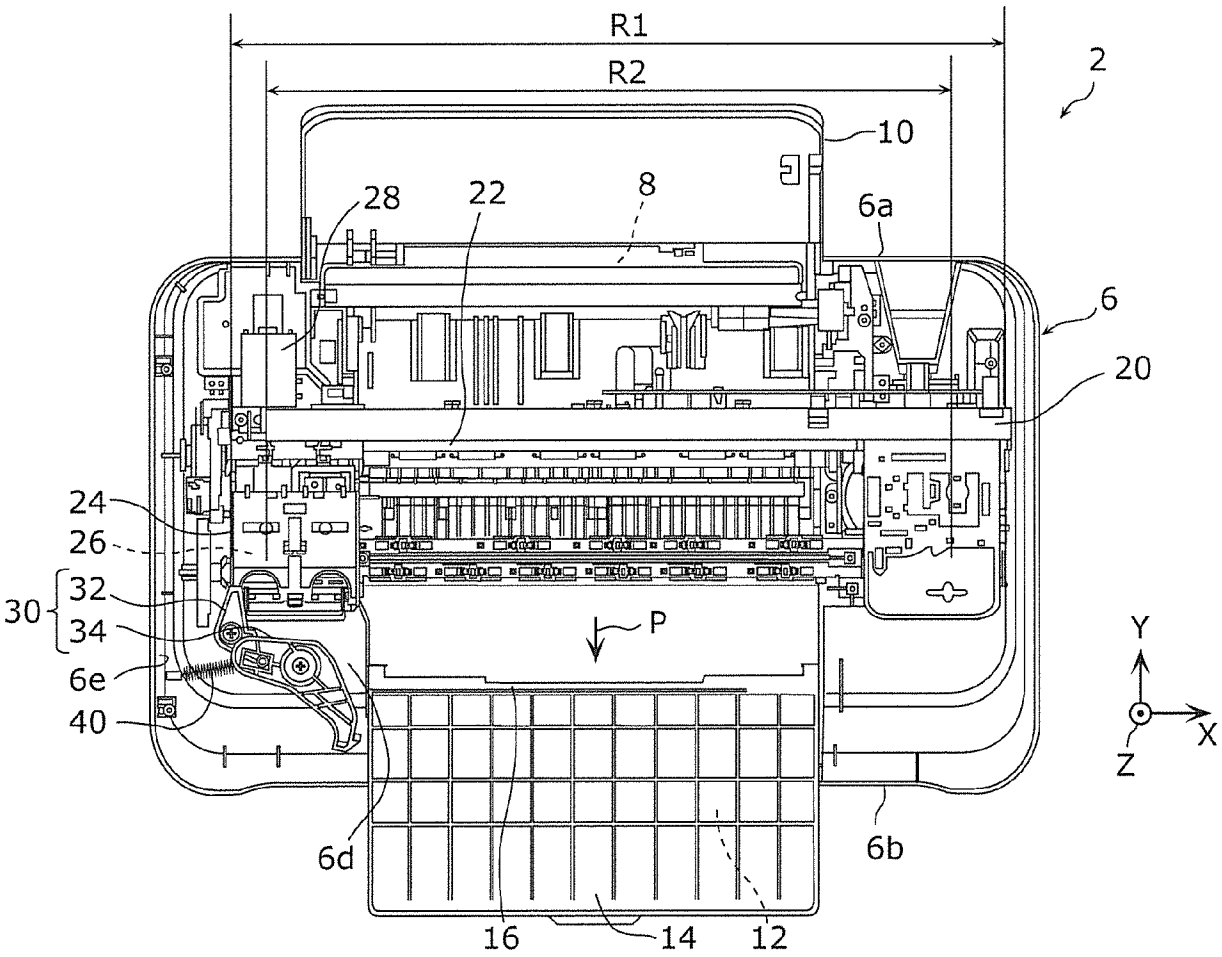
FIG. 6 is a diagram illustrating the internal structure of a printer when a cover is in an open state.
Figure 7:
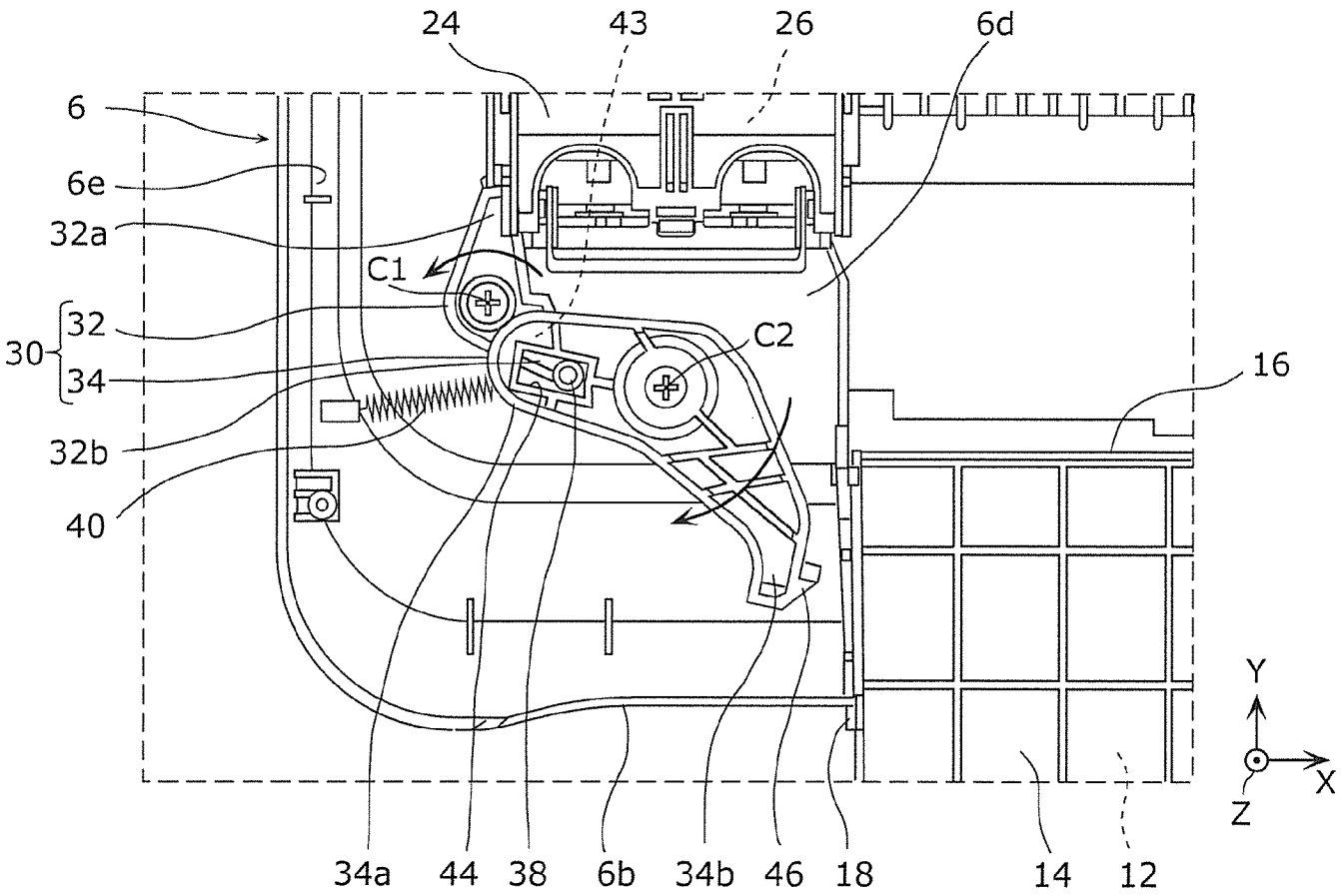
FIG. 7 is a diagram illustrating an enlarged holding mechanism that has released a cover from being held in a closed state.

Next, a holding mechanism 30, the characteristic configuration of the printer 2 according to Embodiment, will be described with reference to aforementioned FIG. 3 as well as FIG. 4 to FIG. 7. FIG. 4 is a diagram illustrating an enlarged holding mechanism that has held a cover in a closed state. FIG. 5 is a perspective view illustrating an enlarged holding mechanism that has held a cover in a closed state. FIG. 6 is a diagram illustrating the internal structure of a printer when a cover is in an open state. FIG. 7 is a diagram illustrating an enlarged holding mechanism that has released a cover from being held in a closed state.

First, the configuration of the holding mechanism 30 will be described. The holding mechanism 30 is a movable part for holding the cover 14 described above in a closed state. As illustrated in FIG. 3 to FIG. 5, the holding mechanism 30 includes the first pivoting part 32 and a second pivoting part 34.

The first pivoting part 32 is substantially V-shaped. As illustrated in FIG. 5, the first pivoting part 32 is pivotally supported by an upper end of a first post 36 that is column-shaped and fixed to an internal bottom surface 6*d* of the housing 6. With this, the first pivoting part 32 is capable of pivoting between a first pivot position (refer to FIG. 3 to FIG. 5) and a second pivot position (refer to FIG. 6 and FIG. 7), on a pivot shaft C1 (corresponding to pivot center) extending in the Z-axis direction. As illustrated in FIG. 3, the first end 32*a* of the first pivoting part 32 is disposed within the first moving range R1 and outside of the second moving range R2. A second end 32*b* of the first pivoting part 32 has a projecting portion 38 that projects upward.

It is to be noted that as illustrated in FIG. 4, the first end 32*a* (point of contact with the carriage 24) of the first pivoting part 32 is disposed inside of the pivot shaft C1 (at a position closer to the carriage 24) in the X-axis direction. With this, the carriage 24 can be brought in contact with the first end 32*a* of the first pivoting part 32 without having to move in the X-axis direction beyond the pivot shaft C1 of the first pivoting part 32. As a result, it is possible to reduce a moving range of the carriage 24 in the X-axis direction, and miniaturize the housing 6 in the X-axis direction.

It is to be noted that the first pivoting part 32 is biased to the first pivot position by a coil spring 40 (corresponding to biasing member). The coil spring 40 has ends connected to an internal surface 6*e* of the housing 6 and the second end 32*b* of the first pivoting part 32, respectively.

The second pivoting part 34 is substantially V-shaped. As illustrated in FIG. 5, the second pivoting part 34 is pivotally supported by an upper end of a second post 42 that is column-shaped and fixed to the internal bottom surface 6*d* of the housing 6. With this, the second pivoting part 34 is capable of pivoting between a third pivot position (refer to FIG. 3 to FIG. 5) and a fourth pivot position (refer to FIG. 6 and FIG. 7), on a pivot shaft C2 extending in the Z-axis direction. The second pivoting part 34 is disposed above the first pivoting part 32 in the Z-axis direction. In other words, as illustrated in FIG. 4, the second end 32*b* of the first pivoting part 32 and a first end 34*a* of the second pivoting part 34 partly overlap with each other in the Z-axis direction in an overlap region 43. The first end 34*a* of the second pivoting part 34 has an opening 44 that is substantially rectangular-shaped. In the overlap region 43, the projecting portion 38 of the first pivoting part 32 is movably inserted into the opening 44 from below. A second end 34*b* (working point at which work is done on the cover 14) of the second pivoting part 34 has a hook 46. As illustrated in FIG. 3 to FIG. 5, when the second pivoting part 34 is in the third pivot position, the hook 46 is engageable with the tab 18 of the cover 14 in the closed state.

As described above, since the projecting portion 38 of the first pivoting part 32 is movably inserted in the opening 44, the second pivoting part 34 pivots in conjunction with the first pivoting part 32 pivoting. Specifically, as shown by arrows in FIG. 7, the second pivoting part 34 pivots, in conjunction with the first pivoting part 32 pivoting in a first direction (counterclockwise in FIG. 7) from the first pivot position to the second pivot position, in a second direction (clockwise in FIG. 7) opposite the first direction from the third pivot position to the fourth pivot position. Moreover, as shown by arrows in FIG. 4, the second pivoting part 34 pivots, in conjunction with the first pivoting part 32 pivoting in the second direction (clockwise in FIG. 4) from the second pivot position to the first pivot position, in the first direction (counterclockwise in FIG. 4) from the fourth pivot position to the third pivot position.

Next, the operation by the holding mechanism 30 will be described. As illustrated in FIG. 3 to FIG. 5, before printing is executed, the holding mechanism 30 holds the cover 14 in the closed state. Specifically, since the first pivoting part 32 is biased to the first pivot position by the coil spring 40, the first pivoting part 32 and the second pivoting part 34 are in the first pivot position and the third pivot position, respectively. With this, the hook 46 of the second pivoting part 34 is engaged with the tab 18 of the cover 14 in the closed state; the cover is held in the closed state.

For instance, a user operates the control panel 19 to start execution of printing. As described above, right before the printing is executed, the carriage 24 moves in the X-axis direction from the standby position within the first moving range R1 (moves beyond the predetermined moving range). As illustrated in FIG. 6 and FIG. 7, when moving to a position opposite the standby position, the carriage 24 comes in contact with the first end 32*a* of the first pivoting part 32 and pushes the first end 32*a* in the X-axis direction. With this, the force of the movement of the carriage 24 is transmitted to the first pivoting part 32, and the first pivoting part 32 pivots in the first direction from the first pivot position to the second pivot position. The second pivoting part 34 pivots in the second direction from the third pivot position to the fourth pivot position in conjunction with the first pivoting part 32 pivoting. With this, the hook 46 of the second pivoting part 34 is disengaged from the tab 18 of the cover 14, and the cover 14 is released from being held in the closed state. As a result, the cover 14 automatically is brought to the open state from the closed state due to its own weight, and the output opening 12 is exposed.

Subsequently, when the printing is executed, the carriage 24 reciprocates in the X-axis direction within the second moving range R2. Here, the first pivoting part 32 pivots in the second direction from the second pivot position to the first pivot position due to biasing force of the coil spring 40. The second pivoting part 34 pivots in the first direction from the fourth pivot position to the third pivot position in conjunction with the first pivoting part 32 pivoting. It is to be noted that when reciprocating in the X-axis direction within the second moving range R2, the carriage 24 neither comes in contact with the first end 32*a* of the first pivoting part 32 nor transmits the force to the first pivoting part 32. With this, the first pivoting part 32 and the second pivoting part 34 are held in the first pivot position and the third pivot position, respectively. The printed medium 4 is outputted to the outside of the housing 6 through the output opening 12.

It is to be noted that when the user manually closes the cover 14 after the execution of the printing is completed, the hook 46 of the second pivoting part 34 is engaged with the tab 18 of the cover 14 in the closed state. With this, the cover 14 is held in the closed state again.

Advantageous Effect

Next, the advantageous effects of the printer 2 according to Embodiment will be described. As described above, since, right before the printing is executed, the force of the movement of the carriage 24 is transmitted to the second pivoting part 34 through the first pivoting part 32, the second pivoting part 34 releases the cover 14 from being held in the closed state. With this, the cover 14 is automatically brought to the open state from the closed state due to its own weight, and the output opening 12 is exposed. For example, since the carriage 24 moves from the standby position right before the printing is executed, it is possible to bring the cover 14 automatically to the open state from the closed state by releasing the cover 14 from being held in the closed state using the force of the movement of the carriage 24. As a result, the printed medium 4 can be outputted to the outside of the housing 6 through the output opening 12, and the occurrence of a paper jam can be reduced.

Modifications

Although the printer 2 according to Embodiment of the present invention has been described above, the present invention is not limited to Embodiment.

In Embodiment, the one end of the coil spring 40 is connected to the first pivoting part 32, but the one end may be connected to the second pivoting part 34. In this case also, the coil spring 40 biases the first pivoting part 32 to the first pivot position.

In Embodiment, when the holding mechanism 30 releases the cover 14 from being held in the closed state, the cover 14 automatically opens due to its own weight. The present invention, however, is not limited to this. For instance, the cover 14 may automatically open due to biasing force of a spring or the like (not shown).

In Embodiment, the hook 46 of the second pivoting part 34 is engaged with the tab 18 of the cover 14, but the present invention is not limited to this. For example, each of the second end 34*b* of the second pivoting part 34 and the end 14*a* of the cover 14 in the X-axis direction may be provided with a magnet (not shown). These magnets are in contact with each other when the cover 14 is in the closed state, and thus the cover 14 is held in the closed state due to the attraction of the magnets.

In Embodiment, the first pivoting part 32 and the second pivoting part 34 have the projecting portion 38 and the opening 44 in the overlap region 43, respectively. Contrary to this, however, the first pivoting part 32 and the second pivoting part 34 may have the opening 44 and the projecting portion 38, respectively.

INDUSTRIAL APPLICABILITY

The printer according to an aspect of the present invention is applicable as, for example, an inkjet printer that prints by discharging ink onto a medium.

The invention claimed is:

1. A printer comprising:

an output part for outputting a medium;

a cover that openably and closably covers the output part;

a carriage that reciprocates in a direction orthogonal to a direction in which the medium is transported, to print on the medium; and a movable part that has a contact point with which the carriage comes into contact and includes a holding part that holds the cover in a closed state, wherein the movable part opens the cover by pivoting when the carriage comes into contact with the contact point.

2. The printer according to claim 1, wherein the movable part includes:

a first pivoting part that has the contact point and pivots in contact with the carriage; and a second pivoting part that includes the holding part and pivots in conjunction with the first pivoting part, and wherein the holding part opens the cover based on the pivoting of the second pivoting part.

3. The printer according to claim 2, wherein the carriage comes into contact with the first pivoting part before the medium is outputted from the output part.

4. The printer according to claim 2, wherein the holding part includes a hook that is engageable with the cover.

5. The printer according to claim 4, wherein the hook is disengaged from the cover to open the cover.

6. The printer according to claim 5, wherein the cover is opened by a weight of the cover.

7. The printer according to claim 2, wherein the first pivoting part pivots between a first pivot position and a second pivot position, and pivots in a first pivoting direction from the first pivot position to the second pivot position when the carriage comes into contact with the contact point, and wherein the second pivoting part pivots between a third pivot position where the holding part is engaged with the cover and a fourth pivot position where the holding part is disengaged from the cover, and pivots in a second pivoting direction from the third pivot position to the fourth pivot position in conjunction with the first pivoting part pivoting from the first pivot position to the second pivot position, the second pivoting direction being opposite the first pivoting direction.

8. The printer according to claim 7, further comprising a biasing member that biases the first pivoting part to the first pivot position.

9. The printer according to claim 7, wherein the first pivoting part and the second pivoting part have an overlap region in which the first pivoting part and the second pivoting part partly overlap with each other, and wherein, in the overlap region, one of the first pivoting part and the second pivoting part has a projecting portion, and another one of the first pivoting part and the second pivoting part has an opening that is substantially rectangular-shaped and into which the projecting portion is movably inserted.

10. The printer according to claim 7, wherein a portion of the first pivoting part that comes into contact with the carriage is disposed inside of a pivot center of the first pivoting part in the direction orthogonal to the direction in which the medium is transported.

* * * * *